US006376816B2

(12) United States Patent
Cooper et al.

(10) Patent No.: US 6,376,816 B2
(45) Date of Patent: Apr. 23, 2002

(54) THIN FILM TUBULAR HEATER

(76) Inventors: Richard P. Cooper, 450 Corral de Tierra Rd., Salinas, CA (US) 93908; Scott A. Cooper, 802 Englewood, Salinas, CA (US) 93906

( * ) Notice: Subject to any disclaimer, the term of this patent is extended or adjusted under 35 U.S.C. 154(b) by 0 days.

(21) Appl. No.: 09/798,678

(22) Filed: Mar. 2, 2001

Related U.S. Application Data

(60) Provisional application No. 60/186,905, filed on Mar. 3, 2000.

(51) Int. Cl.[7] ..... H05B 3/00; H05B 3/40

(52) U.S. Cl. ..... 219/543; 392/480; 219/537; 219/541; 219/546; 338/308

(58) Field of Search ..... 219/543, 541, 219/546, 535, 537; 392/480; 338/306–309

(56) References Cited

U.S. PATENT DOCUMENTS

| | | | | | |
|---|---|---|---|---|---|
| 816,172 | A | * | 3/1906 | Morse et al. | 219/543 |
| 1,767,715 | A | * | 6/1930 | Stoekle | 219/543 |
| 2,022,314 | A | * | 11/1935 | Heyroth et al. | 219/543 |
| 3,105,136 | A | * | 9/1963 | Ashenfarb | 219/544 |
| 4,145,601 | A | * | 3/1979 | Lavrentiev et al. | 392/480 |
| 4,180,723 | A | * | 12/1979 | Szupillo | 219/541 |
| 4,581,521 | A | * | 4/1986 | Grise | 219/535 |
| 4,726,822 | A | * | 2/1988 | Cates et al. | 96/101 |
| 5,027,425 | A | * | 6/1991 | Slomka | 392/480 |
| 5,031,229 | A | * | 7/1991 | Chow | 392/389 |
| 5,557,704 | A | * | 9/1996 | Dennis et al. | 392/480 |
| 5,616,263 | A | * | 4/1997 | Hyllberg | 219/469 |
| 5,616,266 | A | | 4/1997 | Cooper | |
| 5,916,467 | A | * | 6/1999 | Shimada | 219/543 |
| 2001/0003336 | A1 | * | 6/2001 | Abbott et al. | 219/543 |

FOREIGN PATENT DOCUMENTS

| | | | | |
|---|---|---|---|---|
| JP | 2-126585 | * | 5/1990 | 219/543 |

OTHER PUBLICATIONS

Watlow Industries "Thick Film In–line Heaters on Quartz Provide Long Life and Efficient Heat Transfer" brochure.

* cited by examiner

*Primary Examiner*—John A. Jeffery
(74) *Attorney, Agent, or Firm*—Flehr Hohbach Test Albritton & Herbert LLP

(57) ABSTRACT

A tubular thin film resistance heater including a substrate (10) having an electrically non-conductive surface on which is deposited a thin film electrical conductor (12), such as tin oxide. A pair of electrical terminals (14, 16), preferably bus bars, are electrically connected at spaced apart locations on the conductor (12), such as at longitudinal spaced opposed ends or at circumferentially spaced opposed edges of the conductor (12). The thin film conductor (12) is molecularly bonded to the substrate (10) for durability and efficient heat transfer. A method of forming a tubular thin film resistance heater also is disclosed.

2 Claims, 4 Drawing Sheets

THIN FILM TUBULAR HEATER

RELATED APPLICATION

This application is based upon copending provisional application Serial No. 60/186,905, filed Mar. 3, 2000, entitled "Thin Film Tubular Heater."

TECHNICAL FIELD

The present invention relates, in general, to resistance heaters and methods for their formation, and more particularly, relates to tubular resistance heaters suitable for heating fluids.

BACKGROUND ART

Resistance heaters are in widespread use and are constructed in a number of different physical geometries including heater rods, plates and tubes. Moreover, such heaters have been formed using various electrical resistance heating elements, including resistance wires, silicone blankets, thick film in-line paths and thin film areas.

Tubular heaters have been found to be particularly effective in heating fluids, namely, gases and liquids, by flowing the fluid down the inside or over the outside (with a containment structure) of the tubular heater. Resistance wires, blankets and thick film paths have all been previously employed to form tubular resistance heaters, but each of these technologies has been found to have attendant disadvantages.

An example of the use of thick film technology to form a tubular resistance heater is set forth in the advertising flier of Watlow Industries of Atlanta, Ga. entitled "Thick Film In-Line Heaters on Quartz Provide Long Life and Efficient Heat Transfer." Thick film tubular resistance heaters are efficient and they can achieve high watt densities. Thick films, however, are not molecularly bonded to the supporting substrate so they can experience durability problems. Since they employ an "in-line" film path, as the diameter of the tube decreases, the thick film paths become more and more crowded, making them poor candidates for small diameter tubular heaters, for example, heaters for medical catheters.

Similar problems can be encountered when tubular resistance heaters are formed by adhering resistance heater wires to a substrate or when encircling a tubular substrate with a silicone blanket.

Accordingly, it is an object of the present invention to provide a tubular resistance heater, and method for its formation, which has the advantages of efficient heat transfer to fluids, but which also has improved durability and can be formed in very small diameters.

Another object of the present invention is to provide a tubular resistance heater which is easy to construct, can be employed with a variety of substrates and tube sizes, is highly efficient in transferring heat, is compact, and can be constructed for use in many heating applications.

The tubular resistance heater and method of the present invention have other objects and features of advantage which will be apparent from, and are set forth in more detail in, the accompanying drawing and following description of the Best Mode of Carrying Out the Invention.

DISCLOSURE OF THE INVENTION

The tubular resistance heater of the present invention comprises, briefly, a tubular substrate having an electrically non-conductive surface; a thin film electrical conductor deposited on an area of the surface; and a pair of electrical terminals electrically coupled to the thin film electrical conductor at spaced apart locations for the flow of electrical current therebetween through the thin film electrical conductor. Preferably, the tubular substrate is a non-conductive material and the thin film electrical conductor is a molecularly bonded resistance film such as tin oxide. The terminals are preferably in the form of bus bars coupled to opposed edges of the thin film in order to produce series connected, parallel connected and/or series and parallel connected areas of thin film electrical conductor material on the tubular substrate.

The tubular resistance heater forming method of the present invention is comprised, briefly, of the steps of depositing an electrically conductive thin film on an area of an electrically non-conductive surface of a tubular substrate; and electrically coupling a pair of electrical terminals to said electrically conductive thin film at spaced apart positions for the flow of electrical current between the terminals through the thin film.

BEST MODE OF CARRYING OUT THE INVENTION

The present invention comprises forming a tubular resistance heater by depositing an area of a thin film conductor on a tubular substrate for the purpose of creating a highly efficient heater for heating liquids and gases that flow through the tube.

Referring to FIGS. 1A, 1B, 2A and 2B, two embodiments of the tubular thin film heater of the present invention are shown. In both embodiments, the outer non-conductive surface of a tube or tubular substrate 10 is coated with an area of a thin film of electrically conductive material 12. The tubing material is preferably an electrically non-conductive material, such as glass, glass ceramic, or alumina. The tubular substrate also may be an electrically conductive material, such as stainless steel, provided that the surface on which a thin film is to be deposited, usually the outside surface, has a non-conductive coating applied to it. Electrically non-conductive materials suitable for use on conductive tubular substrates include coatings made by DuPont (part #3500) and Electro Science Laboratories (part #4914).

My U.S. Pat. No. 5,616,266 describes methods and compositions for constructing thin film electrically conductive resistance heating elements, and the disclosure of U.S. Pat. No. 5,616,266 is incorporated herein by reference. While the disclosure of my '266 patent shows flat thin film elements, the same basic techniques and compositions can be employed to form a thin film heating element on a tubular object. A necessary change is that the tubular object be rotated during deposition or sputtering of the conductive material onto the tubular member. Vapor deposition of an area thin film electrical conductor 12 in the form of a tin oxide film of about 3000 to about 5000 angstroms is most preferred, but other materials and film thicknesses can be employed, as are well known in the industry and set forth in the '266 patent.

The benefit of using an area of a thin film electrical conductor rather than a path of thick film, as utilized in prior art tubular resistance heater designs, is that thin film conductors can give substantially completely cover the area of the surface on which they are deposited. Moreover, thin film electrical conductors are molecularly bonded to the substrate material being heated. This is not true of thick film conductors. A molecularly bonded thin film conductor significantly improves heat transfer between substrate of the heater and the fluid within or passing over the tube, and it also generally provides more uniform heating because the entire area is covered with the thin film. In addition, a thin film conductor is less prone to damage than a thick film conductor and also improves the surface of the tube. A thin film conductor also can be used for heating extremely small tubes, with diameters in the range of 2–3 millimeters, where it would be impractical to use thick film conductor laid out in a circuitous path.

Figures 1A, 1B:
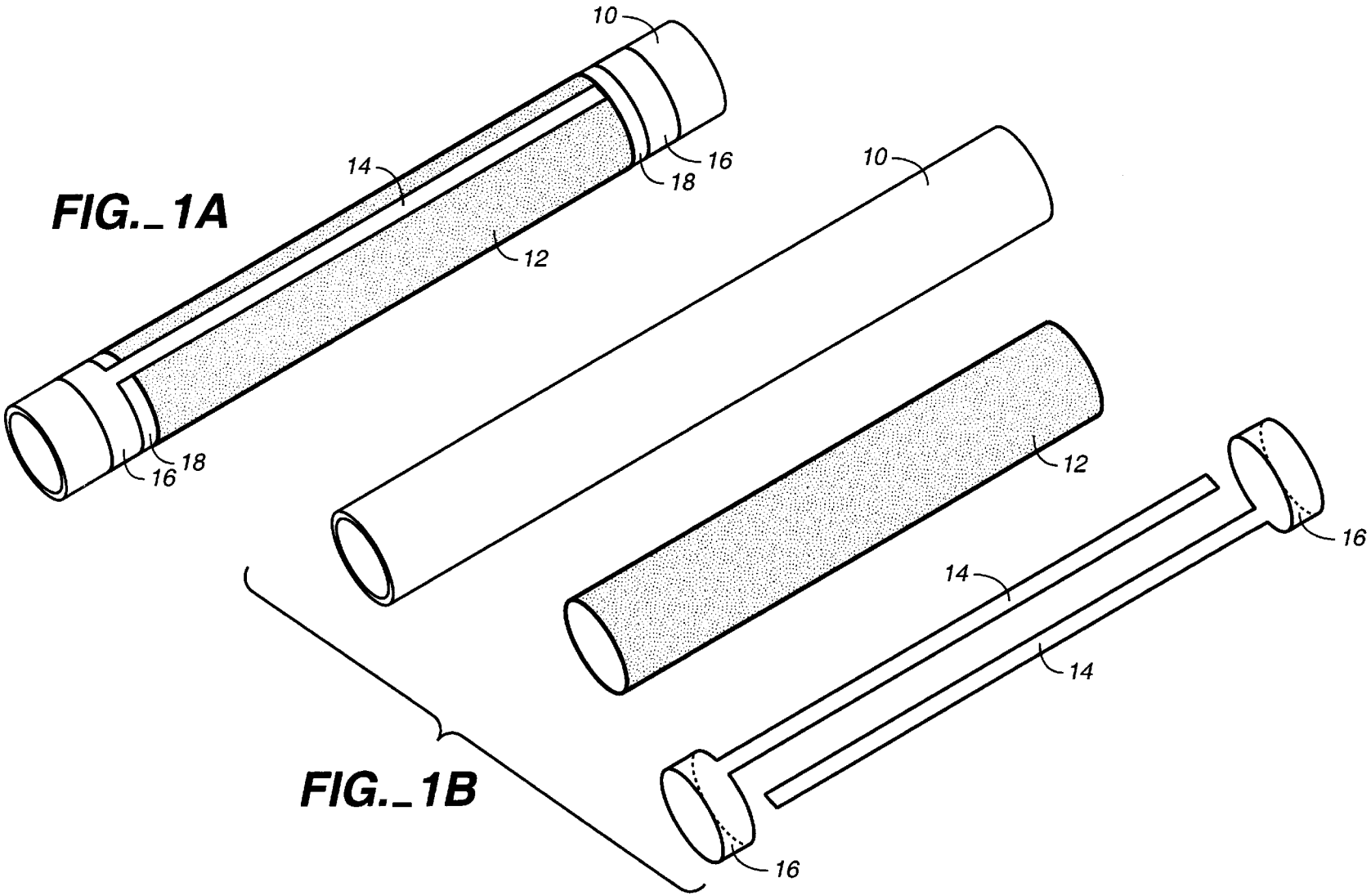
FIG. 1A is a perspective view of a first embodiment of a tubular thin film heater constructed in accordance with the present invention.
FIG. 1B is a perspective exploded view of the components of the heater of FIG. 1A.
Figure 3A:
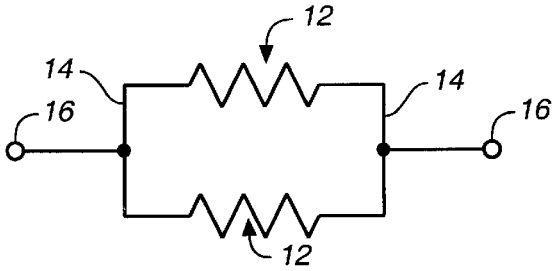
FIG. 3A is a schematic circuit diagram for the heater embodiment of FIGS. 1A and 1B.

In the embodiment of FIGS. 1A and 1B, terminals or electrodes 14 are run parallel to the longitudinal axis of tube 10 at 180° from each other around the circumference of the tube. This construction creates two resistive heater areas each of which are dimensioned to have a circumferential dimension equal to about one-half of the tube circumference 3 and a length dimension along substrate 10 which is usually greater than the circumferential dimension. Electrode bus bar terminals 14 each are electrically coupled to one of a circumferentially extending end bands or end terminals 16. Terminals 16 can be electrically coupled to power source, not shown, in a conventional manner. Electrically non-conductive annular bands or spaces 18 are provided between end terminals 16 and thin film conductor areas 12, in order to create a parallel resistive heater connection arrangement, which is schematically illustrated in FIG. 3A.

Figures 2A, 2B:
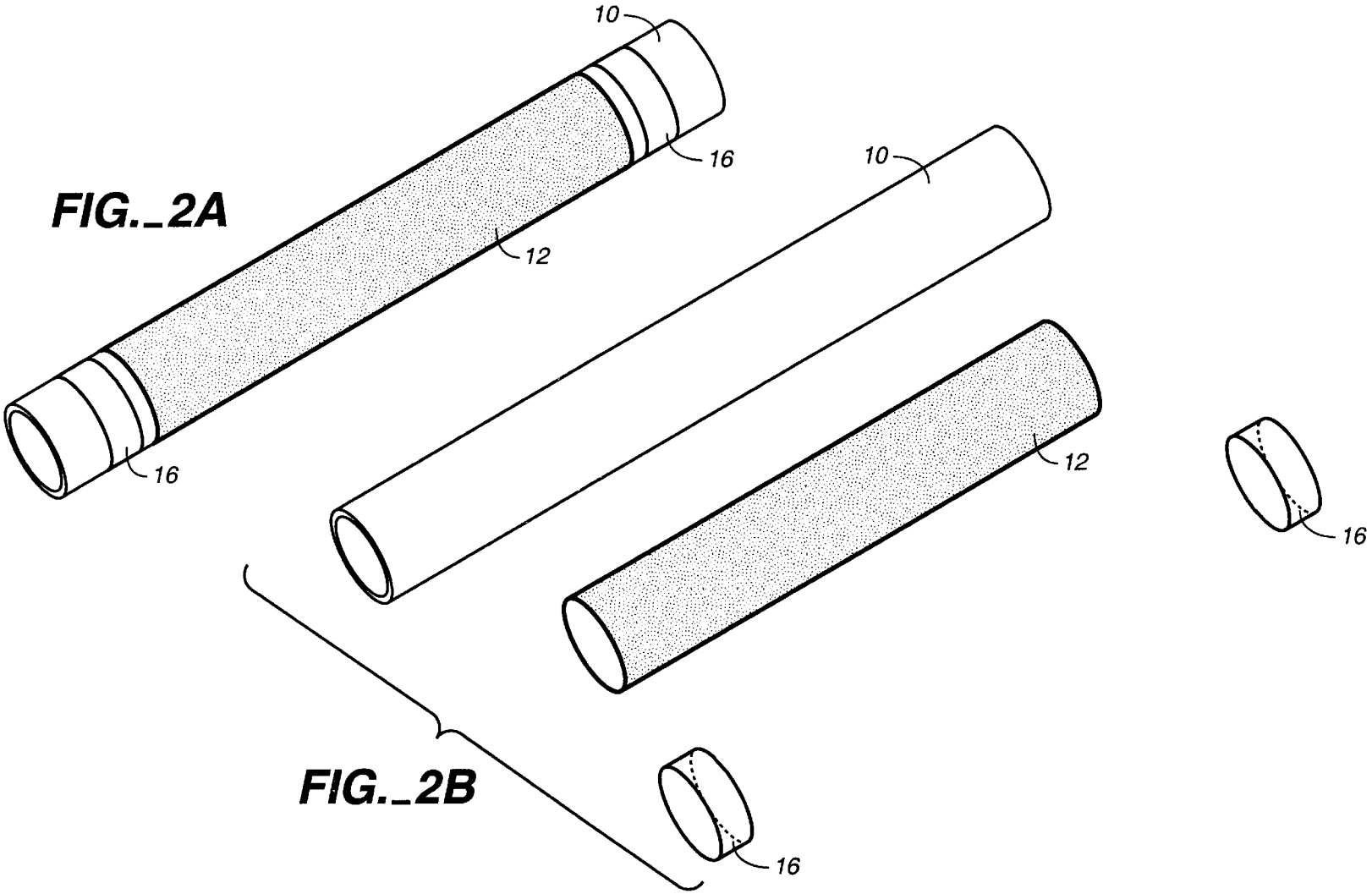
FIG. 2A is a perspective view of a second embodiment of the tubular thin film heater of the present invention.
FIG. 2B is a perspective exploded view of the components of the heater of FIG. 2A.
Figure 3B:
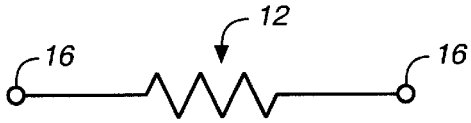
FIG. 3B is a schematic circuit diagram for the heater embodiment of FIGS. 2A and 2B.

Alternatively, as shown in FIGS. 2A and 2B, end bus bars or terminals 16 are applied around the circumference of tube 10 at the ends of the deposited thin film conductor area 12, and the parallel, longitudinally extending terminals 14 are eliminated. With this alternative arrangement, longitudinally spaced apart electrodes or terminals 16 couple an area of thin film heater conductor 12 which has no spaces or gaps between terminals 16. This alternative design creates a resistive heater element which is coupled in series between the band-like end bus bars 16, as opposed to the parallel arrangement of FIGS. 1A and 1B. This series connection is shown schematically in FIG. 3B.

Because in both embodiments thin film conductor area 12 is electrically and thermally hot, it is preferable for most applications to coat the conductor and bus bar areas with an electrically insulated glaze (not shown), such as DuPont QS580, or a material such as Electro Science Laboratories Resistor Overglaze 4771-G, or to wrap the tube with a material that provides both heat insulation and electrical insulation. Examples of such a wrap include silicon or Kapton tape. In some cases where less than 24 volts is employed, there is no significant safety hazard, and the provision of insulation can be eliminated.

Figures 4, 5:
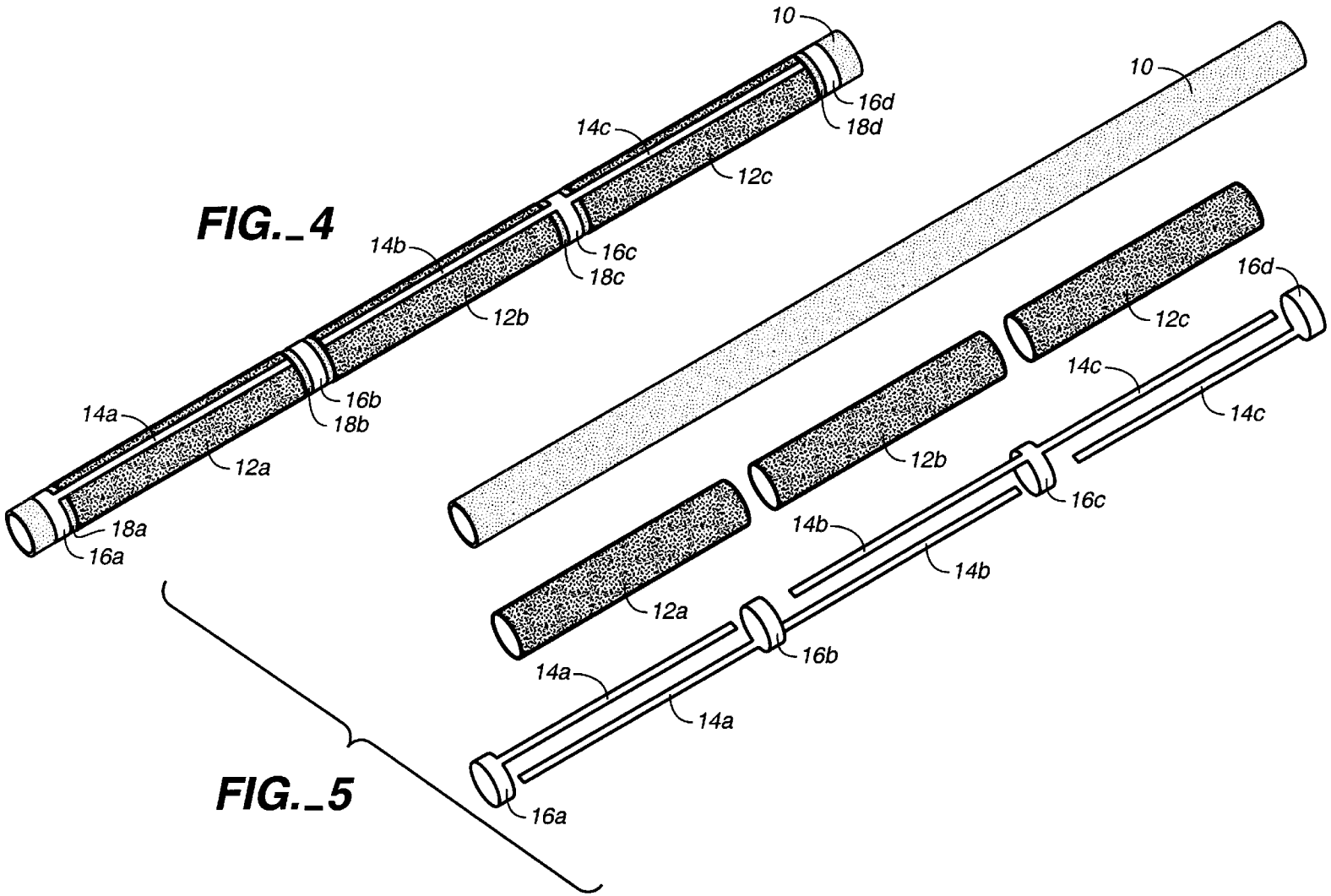
FIG. 4 is a perspective view of a third embodiment of the tubular thin film heater of the present invention.
FIG. 5 is a perspective exploded view of the components of the heater of FIG. 4.

FIGS. 4 and 5 show a third embodiment, which is a variation of the embodiment of FIGS. 1A and 1B. With this third design, the thin film heater conductor element is broken up into three parallel heating elements or areas 12*a*, 12*b* and 12*c*, with narrow non-conductive annular spaces 18*b* and 18*c* provided therebetween.

Figure 6:
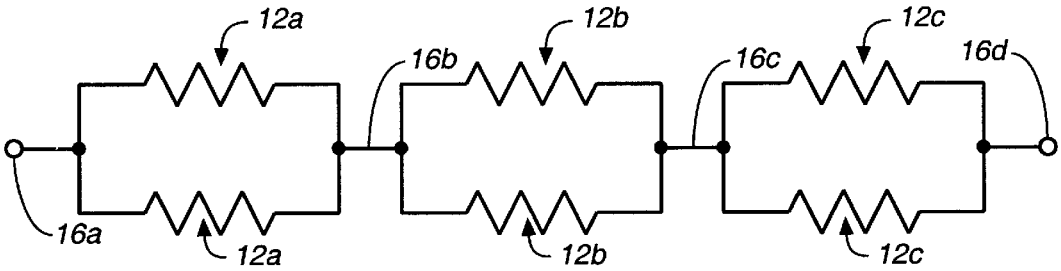
FIG. 6 is a schematic circuit diagram for the heater embodiment of FIGS. 4 and 5.

A set of four circumferential band terminals or electrodes 16*a*–16*d* are provided, two proximate the ends of the heating area and two positioned between the three separate heating elements 12*a*, 12*b* and 12*c* in the electrically non-conductive spaces indicated by reference numerals 18*b* and 18*c*. In addition, parallel terminal or electrode pairs 14*a*, 14*b* and 14*c* are provided between band terminals 16*a*–16*d*, as shown in FIG. 5. This arrangement creates a set of three parallel pairs of resistive heating area elements, which pairs of areas are connected longitudinally in series, as shown schematically in FIG. 6. The examples included herein for particular designs show the power obtainable with the present invention, but in general, the parallel resistive heater arrangements are thought to provide more heating capacity than series connected heating elements.

High watt densities can be attained with the designs of FIGS. 1–6, particularly because the fluids or gases flowing inside the tubular substrate absorb heat from the substrate. The reduction of substrate temperature also minimizes overheating of the thin film and increases its efficiency. Watt densities of 150 watts per square inch have been attained and sustained.

EXAMPLES

The following is an example of a thin film resistance heater constructed with the parallel conductor connection arrangement of FIGS. 1A and 1B:

The tube outside diameter was 0.39"

The tube inside diameter was 0.31"

The tube length was 7.13"

The coated length of the tube was 5.57"

The area of the outside of the tube was 8.73 square inches

The thin film coated area of the outside of the tube was tin oxide having an area of 6.82 square inches The coating resistivity of the conductive thin film was 415 Ω/square Two bus bars 14 run at 180° parallel to the length of the tube effectively dividing the thin film into two equal heating elements electrically connected along opposed circumferentially spaced edges The bus bars were 0.039" wide The circumference of the heater was 1.2246"

Therefore, the coated area of one-half of the total tube was 3.41" square inches, less 0.039×5.57" (area of the bus bar) or 3.389 square inches Number of squares in one-half the heater is (1.2246×0.5)−0.39"=0.5733", which is the length (direction of current flow) divided by width which is 5.57"=0.102 squares.

Total Resistance=Sheet resistance×No. of Squares or 415×0.102=42.33 Ω

At 120 volts, this equals 340 watts, ×2 resistors or a total of 680 watts.

The sheet resistance of 415 Ω requires a very thin tin oxide film that may present difficulty in controlling uniform film thickness during atmospheric chemical vapor deposition. Therefore, it may be more practical to apply a slightly thicker thin film, which would still result in a very high powered heater in the above example.

A preferred thin film tubular resistance heater arrangement may be the series/parallel design of resistors shown in FIGS. 4 and 5. With this type of arrangement, sheet resistance can be lowered considerably to a level which will enhance practicality of manufacturing process by allowing a thin film heater which has a somewhat more easily controlled greater film thickness.

If the same tube is divided into three sections, as in the embodiment of FIGS. 4 and 5, the number of squares increases, and a practical heater design can be obtained, as shown by the following example:

Each of three heating elements was 0.39" in diameter by 1.79" long, which equals 1.0024 square inches of area The bus bars (0.1" in width) intersect the 0.39" dimension and reduces the distance of the circumference by 0.2"

The effective, thin film coated area of each heating element was 0.56"×1.79" or 1.0024 square inches The number of squares was 0.56 divided by 1.79 or 3.12 squares To obtain a total of 680 watts for the heater, each half section of a heating element must be 113.36 watts Resistance=Voltage squared divided by watts, or 14,400/680=21.17 Ω

Sheet Resistance=Resistance/#Squares or 21.07/1.0024=20.99 Ω.

The present tubular thin film heater design has applicability in a variety of processes, including heating of liquids, such as in water heaters, and the heating of gases, slurries, glue applicators, and catheters, and also in shrink wrap heating.

Testing using ceramic tube heaters have produced the following results:

Calculated Quantities:

Power supplied to heater (watts)=input voltage (ACRMS) *input current (ACRMS)

Delta T (°C.)=outlet water temperature−inlet water temperature dM/dT (grams/second)=flow rate (mills/minute)*density (grams per mill)/60 (seconds per minutes)

Power input to water (watts)=dM/dT*$C_{P(H20)}$*Delta T

Note: Cp of water=1 calorie per gram-degree C=4.184 joules per gram-degree C.

Data:

Input current=6.42

Input voltage=129.4

Input watts=830 watts

Water flow=990

Inlet temp=13.1° C.

Outlet temp=24.5° C.

Delta T=11.4° C.

Transferred watts=787 watts

Tube temp=269° C.

From this test, approximately 43 watts was presumably lost to the air, which is roughly 5% of the total input power.

An additional facet of the heater's performance was also measured, that being the heater's outer surface temperature rise as it starts cold while water is flowing. The measurements were as follows:

| Time (seconds) | Temperature (° C.) |
|---|---|
| 0 | 13.7 |
| 5 | 197 |
| 10 | 235 |
| 15 | 248 |
| 20 | 252 |
| 25 | 255 |
| 30 | 257 |
| 35 | 260 |
| 40 | 261 |
| 50 | 264 |
| 60 | 266 |

Figure 7:
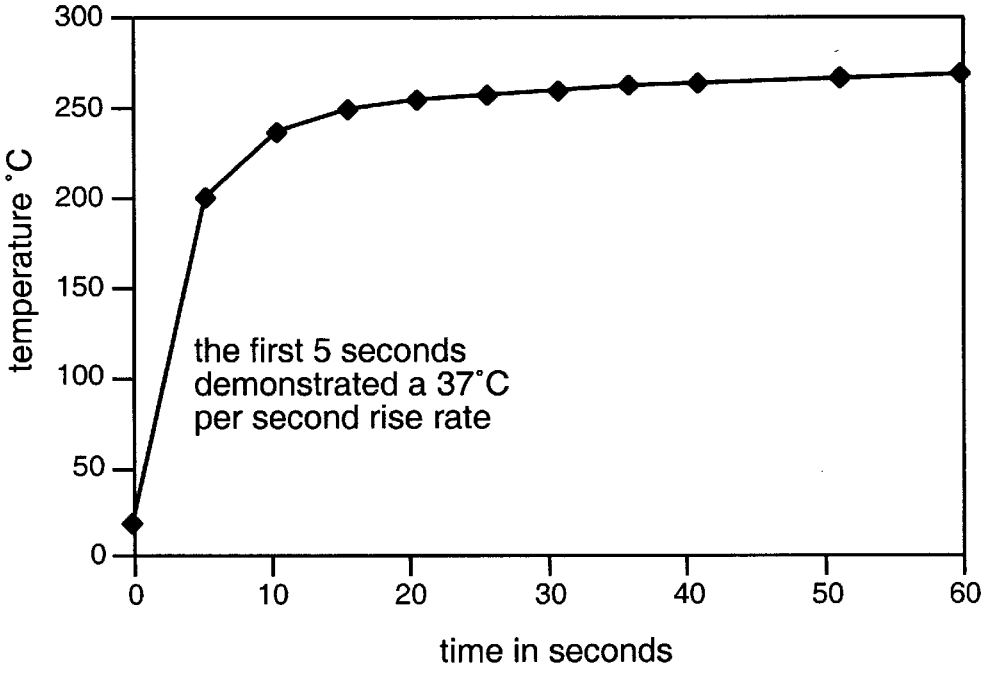
FIG. 7 is a graphical representation of the temperature versus time curve for heating of a ceramic substrate outer surface in a tubular resistance heater constructed as shown in FIG. 1A.

These data are shown in FIG. 7.

What is claimed is:

1. A tubular thin film resistance heater comprising:

a tubular substrate having an electrically non-conductive surface;

a plurality of areas of thin film electrical conductor deposited on said surface; and bus bars electrically coupled to said plurality of areas at spaced apart locations for the flow of current therebetween through said plurality of areas, said bus bars being electrically connected to said plurality areas to produce both a series and a parallel connection of said plurality of areas on said tubular substrate.

2. A method for forming a tubular resistance heater comprising the steps of:

depositing an electrically conductive thin film on a plurality of areas of an electrically non-conductive surface of a tubular substrate; and electrically coupling a plurality of electrical terminals to said electrically conductive thin film at spaced apart positions thereon to produce both a series and a parallel connection of said plurality of areas on the substrate for the flow of electrical current between said terminals through said plurality of areas of electrically conductive thin film.

* * * * *